US010008109B2

(12) United States Patent
Witkowski et al.

(10) Patent No.: US 10,008,109 B2
(45) Date of Patent: Jun. 26, 2018

(54) SYSTEM AND METHOD FOR TRAINING A PROGRAMMABLE TRANSCEIVER

(71) Applicant: Gentex Corporation, Zeeland, MI (US)

(72) Inventors: Todd R. Witkowski, Zeeland, MI (US); Ivo Ivanov Bonev, Sofia (BG); Plamen Chavdarov Stoyanov, Sofia (BG); Stefan Rumenov Nikolov, Sofia (BG)

(73) Assignee: GENTEX CORPORATION, Zeeland, MI (US)

( * ) Notice: Subject to any disclaimer, the term of this patent is extended or adjusted under 35 U.S.C. 154(b) by 152 days.

(21) Appl. No.: 14/363,441

(22) PCT Filed: Dec. 6, 2012

(86) PCT No.: PCT/US2012/068209

§ 371 (c)(1),
(2) Date: Jun. 6, 2014

(87) PCT Pub. No.: WO2013/086166

PCT Pub. Date: Jun. 13, 2013

(65) Prior Publication Data

US 2015/0009021 A1 Jan. 8, 2015

Related U.S. Application Data

(60) Provisional application No. 61/568,728, filed on Dec. 9, 2011.

(51) Int. Cl.
*G08C 17/02* (2006.01)
*G07C 9/00* (2006.01)

(52) U.S. Cl.
CPC ..... *G08C 17/02* (2013.01); *G07C 9/00857* (2013.01); *G07C 9/00309* (2013.01)

(58) Field of Classification Search
CPC ..... G07C 9/00857; G07C 9/00888; G07C 9/00896; G08C 2201/21; G08C 2201/51;
(Continued)

(56) References Cited

U.S. PATENT DOCUMENTS 4,549,311 A * 10/1985 McLaughlin ..... H04B 7/0805 455/166.1
5,614,885 A 3/1997 Van Lente et al.
(Continued)

OTHER PUBLICATIONS

Patent Examination Report No. 1 in corresponding Australian Application No. 2012347817 dated Oct. 10, 2014, 2 pages.
(Continued)

*Primary Examiner* — Steven Lim
*Assistant Examiner* — Mancil Littlejohn, Jr.
(74) *Attorney, Agent, or Firm* — Foley & Lardner LLP; Bradley D. Johnson

(57) ABSTRACT

A method for training a programmable transceiver is provided that includes scanning frequencies within a desired range for a first signal, and detecting the first signal at a first frequency. The method also includes computing harmonic frequencies and subharmonic frequencies of the first frequency, and scanning the harmonic frequencies and the subharmonic frequencies for a second signal at a second frequency. The method further includes comparing a first magnitude of the first signal to a second magnitude of the second signal. In addition, the method includes training the programmable transceiver based on the second signal if the second magnitude is greater than the first magnitude, otherwise training the programmable transceiver based on the first signal.

20 Claims, 4 Drawing Sheets

(58) Field of Classification Search
CPC ..... G08C 2201/92; H04B 1/38; G01R 23/16; G01R 23/005; G01R 23/02; G01S 13/34
USPC ..... 340/12.5, 12.28, 12.2, 5.22, 5.26, 5.7, 340/825.69, 825.72; 455/420, 418, 419, 455/99, 344, 345, 41.2; 307/10.1
See application file for complete search history.

(56) References Cited

U.S. PATENT DOCUMENTS

| | | | | |
|---|---|---|---|---|
| 5,793,300 | A | 8/1998 | Suman et al. | |
| 7,889,050 | B2 | 2/2011 | Witkowski | |
| 2002/0137460 | A1* | 9/2002 | Sun | G07C 9/00857 455/41.2 |
| 2003/0190902 | A1* | 10/2003 | Horie | H01Q 1/247 455/272 |
| 2004/0075341 | A1 | 4/2004 | Belinguier | |
| 2005/0261023 | A1* | 11/2005 | Yang | H04M 1/72522 455/556.1 |
| 2011/0034132 | A1* | 2/2011 | Babitch | H04B 15/02 455/76 |
| 2011/0043328 | A1* | 2/2011 | Bassali | G07C 9/00182 340/5.71 |

OTHER PUBLICATIONS

International Preliminary Report on Patentability and Written Opinion of the International Searching Authority dated Jun. 19, 2014, 8 pages.
International Search Report in PCT/US2012/068209.

* cited by examiner

SYSTEM AND METHOD FOR TRAINING A PROGRAMMABLE TRANSCEIVER

CROSS REFERENCE TO RELATED APPLICATIONS

The present application is a U.S. National Stage of International Application No. PCT/US2012/068209 filed on Dec. 6, 2012, which claims the benefit of Provisional Patent Application No. 61/568,728 filed on Dec. 9, 2011, the entire disclosures of all of which are incorporated herein by reference.

BACKGROUND

The invention relates generally to a system and method for training a programmable transceiver.

Certain vehicles include a programmable transceiver configured to operate a variety of remote devices. In certain configurations, the programmable transceiver is configured to receive a training signal from a training transmitter, and to store the training signal within a memory. In such configurations, subsequent activation of the programmable transceiver broadcasts a signal that substantially corresponds to the training signal. As a result, the programmable transceiver may operate a remote device associated with the training transmitter. By way of example, to train a programmable transceiver to operate a garage door opener, a transmitter associated with the garage door opener is positioned proximate to the programmable transceiver. The programmable transceiver is then placed into a training mode, in which the programmable transceiver scans typical transmitter frequencies until a signal is detected. The programmable transceiver then stores information associated with the signal within the memory, thereby enabling the programmable transceiver to simulate the garage door opener transmitter upon subsequent activation.

As will be appreciated, transmitters may operate within a variety of frequency ranges. For example, certain transmitters may broadcast signals within a range of about 285 MHz to about 440 MHz. Other transmitters may broadcast signals within a range of about 867 MHz to about 869 MHz. Consequently, as the programmable transceiver scans frequencies within a desired range, the programmable transceiver may detect a harmonic frequency or a subharmonic frequency of the training signal fundamental frequency. As a result, the programmable transceiver may be trained based on the subharmonic or harmonic frequency. Accordingly, subsequent activation of the programmable transceiver may broadcast a signal at an incorrect frequency. For example, if the training transmitter broadcasts a signal at about 868 MHz, and the programmable transceiver scans a frequency range of about 285 MHz to about 440 MHz, the programmable transceiver may detect a subharmonic frequency of the training signal at about 434 MHz. Consequently, the programmable transceiver may be trained based on the signal at the subharmonic frequency. As a result, subsequent activation of the programmable transceiver may not activate the remote device associated with the training transmitter because the signal broadcast by the programmable transceiver is at an incorrect frequency.

BRIEF DESCRIPTION OF THE INVENTION

The present invention relates to a method for training a programmable transceiver including scanning frequencies within a desired range for a first signal, and detecting the first signal at a first frequency. The method also includes computing harmonic frequencies and subharmonic frequencies of the first frequency, and scanning the harmonic frequencies and the subharmonic frequencies for a second signal at a second frequency. The method further includes comparing a first magnitude of the first signal to a second magnitude of the second signal. In addition, the method includes training the programmable transceiver based on the second signal if the second magnitude is greater than the first magnitude, otherwise training the programmable transceiver based on the first signal.

The present invention also relates to a programmable transceiver including a controller configured to scan frequencies within a desired range for a first signal, and to detect the first signal at a first frequency. The controller is also configured to compute harmonic frequencies and subharmonic frequencies of the first frequency, and to scan the harmonic frequencies and the subharmonic frequencies for a second signal at a second frequency. In addition, the controller is configured to compare a first magnitude of the first signal to a second magnitude of the second signal, and to train the programmable transceiver based on the second signal if the second magnitude is greater than the first magnitude, and to otherwise train the programmable transceiver based on the first signal.

The present invention further relates to a programmable transceiver including a transceiver configured to receive a training signal from a training transmitter, and a memory configured to store information associated with the training signal. The programmable transceiver also includes a controller configured to instruct the transceiver to scan frequencies within a desired range for a first signal, and to detect the first signal at a first frequency. The controller is also configured to compute harmonic frequencies and subharmonic frequencies of the first frequency, and to instruct the transceiver to scan the harmonic frequencies and the subharmonic frequencies for a second signal at a second frequency. In addition, the controller is configured to compare a first magnitude of the first signal to a second magnitude of the second signal, and to establish the training signal based on the second signal if the second magnitude is greater than the first magnitude, and to otherwise establish the training signal based on the first signal. The controller is also configured to store the information associated with the training signal in the memory.

DRAWINGS

DETAILED DESCRIPTION

Figure 1:
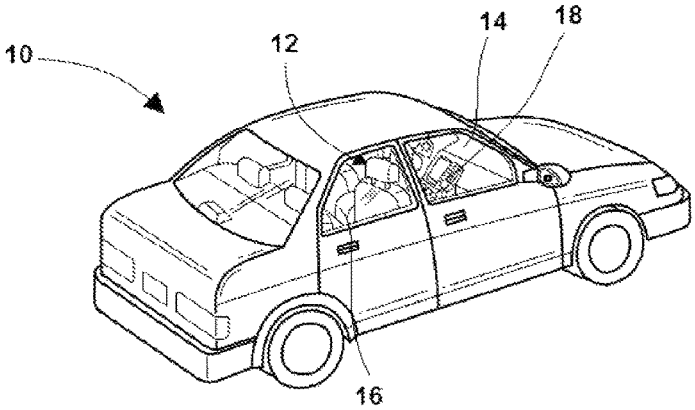
FIG. 1 is a perspective view of an exemplary vehicle that may include a programmable transceiver.

FIG. 1 is a perspective view of a motor vehicle 10 that may include a programmable transceiver. As illustrated, the vehicle 10 includes an interior 12 having an instrument panel 14, an armrest 16, and a center console 18. As discussed in detail below, the vehicle interior 12 includes a programmable transceiver configured to substantially reduced or eliminate the possibility of training the programmable transceiver based on a signal at a harmonic frequency or a subharmonic frequency of the training signal. In certain embodiments, the programmable transceiver includes a controller configured to scan frequencies within a desired range for a first signal, and to detect the first signal at a first frequency. The controller is also configured to compute harmonic frequencies and subharmonic frequencies of the first frequency, and to scan the harmonic frequencies and the subharmonic frequencies for a second signal at a second frequency. In addition, the controller is configured to compare a first magnitude of the first signal to a second magnitude of the second signal, and to train the programmable transceiver based on the second signal if the second magnitude is greater than the first magnitude, and to otherwise train the programmable transceiver based on the first signal. Because the controller is configured to train the programmable transceiver based on the signal having the larger magnitude, the possibility of training the transceiver based on a harmonic or subharmonic frequency of the training signal is substantially reduced or eliminated, thereby enabling the programmable transceiver to accommodate a wide variety of frequency ranges.

Figure 2:
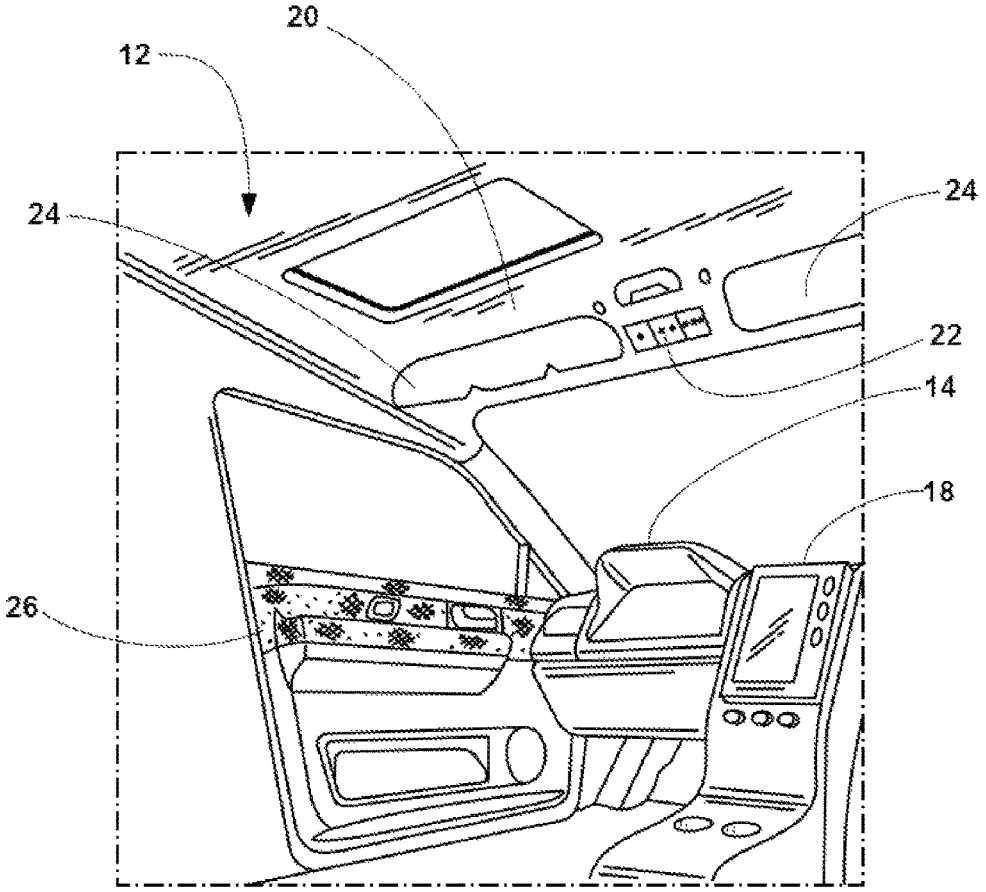
FIG. 2 is a perspective view of a part of the interior of the vehicle of FIG. 1.

FIG. 2 is a perspective view of a part of the interior 12 of the vehicle 10 of FIG. 1. As illustrated, the vehicle interior 12 includes a headliner 20 having an integrated programmable transceiver 22. In certain embodiments, the programmable transceiver 22 may be a HomeLink® system by Johnson Controls. As discussed in detail below, the programmable transceiver 22 is configured to receive a training signal from a training transmitter, and to store the training signal within a memory. Accordingly, subsequent activation of the programmable transceiver 22 broadcasts a signal that substantially corresponds to the training signal. As a result, the programmable transceiver 22 may operate a remote device associated with the training transmitter. In the present embodiment, the programmable transceiver 22 is configured to scan subharmonic and/or harmonic frequencies of the training signal to determine whether a frequency of the signal received by the programmable transceiver 22 corresponds to the frequency of the training signal broadcast by the training transmitter. If not, the programmable transceiver 22 is trained based on a signal at a harmonic frequency or a subharmonic frequency having the greatest magnitude. In this manner, the possibility of training the programmable transceiver 22 based on an incorrect frequency is substantially reduced or eliminated. While the programmable transceiver 22 is integrated within the vehicle interior headliner 20 in the illustrated embodiment, it should be appreciated that the programmable transceiver may be integrated within other components of the vehicle interior 12 and/or the vehicle exterior. For example, in certain embodiments, a sun visor 24, an interior door panel 26, an instrument panel 14, an armrest 16, a center console 18, and/or a vehicle bumper may include an integrated programmable transceiver.

Figure 3:
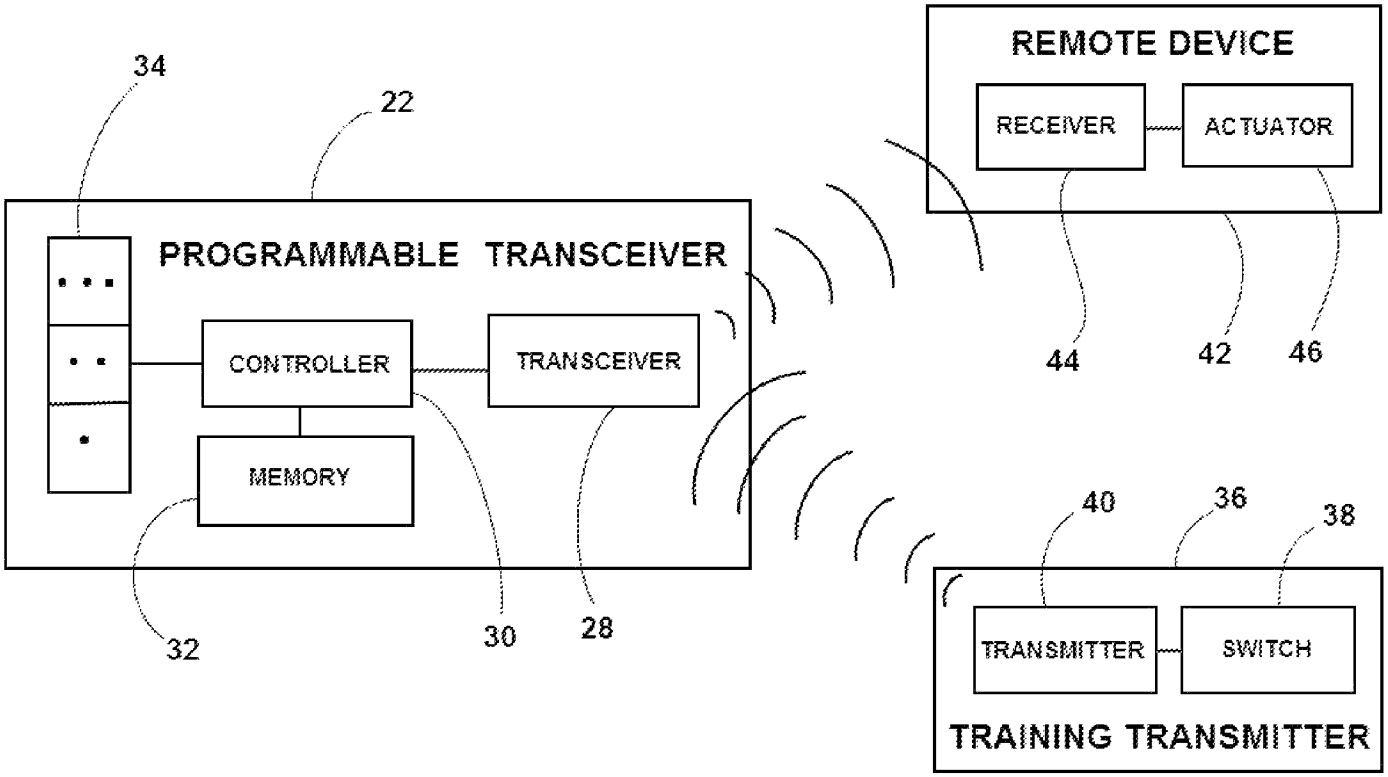
FIG. 3 is a schematic view of an embodiment of a programmable transceiver configured to communicate with a remote device and a training transmitter.

FIG. 3 is a schematic view of an embodiment of a programmable transceiver 22 configured to communicate with a remote device and a training transmitter. As discussed in detail below, the programmable transceiver 22 may be trained based on a training signal from the training transmitter, thereby enabling the programmable transceiver 22 to operate the remote device. In the illustrated embodiment, the programmable transceiver 22 includes a transceiver 28, a controller 30, a memory 32, and buttons 34. The transceiver 28 is configured to receive a training signal from a training transmitter 36, and the memory 32 is configured to store information associated with the training signal. As discussed in detail below, the controller 30 is configured to instruct the transceiver 28 to scan frequencies within a desired range, and to detect a first signal. The controller 30 is also configured to compute harmonic frequencies and subharmonic frequencies of the first signal, and to instruct the transceiver 28 to scan the computed frequencies for a second signal. In addition, the controller 30 is configured to establish the training signal based on the second signal if a magnitude of the second signal is greater than a magnitude of the first signal, and to otherwise establish the training signal based on the first signal. Once the training signal is established, the controller 30 is configured to store information associated with the training signal within the memory 32.

By way of example, an operator may initiate the training process by depressing an unassigned button 34 of the programmable transceiver 22. The operator then places the training transmitter 36 in proximity to the programmable transceiver 22, and engages a switch 38 on the training transmitter 36, thereby activating a transmitter 40. The transmitter 40 broadcasts a signal to the transceiver 28 including information associated with activation of a remote device 42. For example, the information may include a security code configured to block unauthorized users from activating the remote device 42. To detect the training signal, the controller 30 instructs the transceiver 28 to scan frequencies within a desired range for the training signal broadcast by the transmitter 40. For example, the controller 30 may instruct the transceiver 28 to scan upwardly through the desired range by a fixed frequency increment, and downwardly through the desired range by the fixed frequency increment until a signal is detected.

Upon detection of the signal, the controller 30 computes harmonic frequencies and subharmonic frequencies of the detected signal frequency. In certain embodiments, the controller 30 is configured to determine whether each computed harmonic and subharmonic frequency is within an expected frequency range (e.g., within a frequency range of known transmitters). If the computed frequency is within the expected range, the controller 30 instructs the transceiver 28 to scan the frequency for a second signal. If a second signal is detected, the controller 30 compares a first magnitude of the first signal to a second magnitude of the second signal. A greater first magnitude indicates that the first signal is broadcast at a fundamental frequency, and the second signal corresponds to a harmonic or subharmonic frequency. Conversely, a greater second magnitude indicates that the second signal is broadcast at a fundamental frequency, and the first signal corresponds to a harmonic or subharmonic frequency. Consequently, if the second magnitude is greater than the first magnitude, the controller 30 establishes the training signal based on the second signal. Otherwise, the controller 30 establishes the training signal based on the first signal. The controller 30 then stores the information associated with the training signal in the memory 32. For example, the controller 30 may assign the information associated with the training signal to the unassigned button previously depressed by the operator.

While the process described above relates to assigning information associated with a training signal to an unassigned button, it should be appreciated that signal information may also be assigned to a previously assigned button. For example, in certain embodiments, depressing a previously assigned button for a particular duration (e.g., about 20 seconds) induces the programmable transceiver to enter a training mode. In such embodiments, information associated with a training signal may be assigned to the previously assigned button by depressing the previously assigned button for the particular duration, and then activating the training transmitter. In this manner, the information associated with the training signal is assigned to a desired button, thereby enabling the button to activate a remote device.

Once the information associated with the training signal is stored within the memory 32, subsequently depressing the assigned button instructs the transceiver 28 to broadcast the information associated with the training signal, thereby activating the remote device 42. For example, in certain embodiments, the remote device 42 may be a garage door opener having a receiver 44, and an actuator 46. Upon receiving the information associated with the training signal at the expected frequency, the receiver 44 instructs the actuator 46 to drive a garage door to open or close. In this manner, the programmable transceiver 22 may be utilized instead of the training transmitter 36 to control the remote device 42.

In certain embodiments, the signal information may include data indicative of the signal frequency. For example, if the training transmitter broadcasts a training signal at 868 MHz, the signal information may include data indicative of an 868 MHz broadcast frequency. Accordingly, if the programmable transceiver detects a signal at 434 MHz, the controller may determine that the detected signal is at a subharmonic frequency of the training signal frequency based on the information within the training signal indicating that the signal frequency is 868 MHz. As a result, the programmable transceiver may be trained based on the fundamental frequency of the training transmitter, thereby substantially reducing or eliminating the possibility of training the programmable transceiver based on an incorrect frequency.

Figure 4:
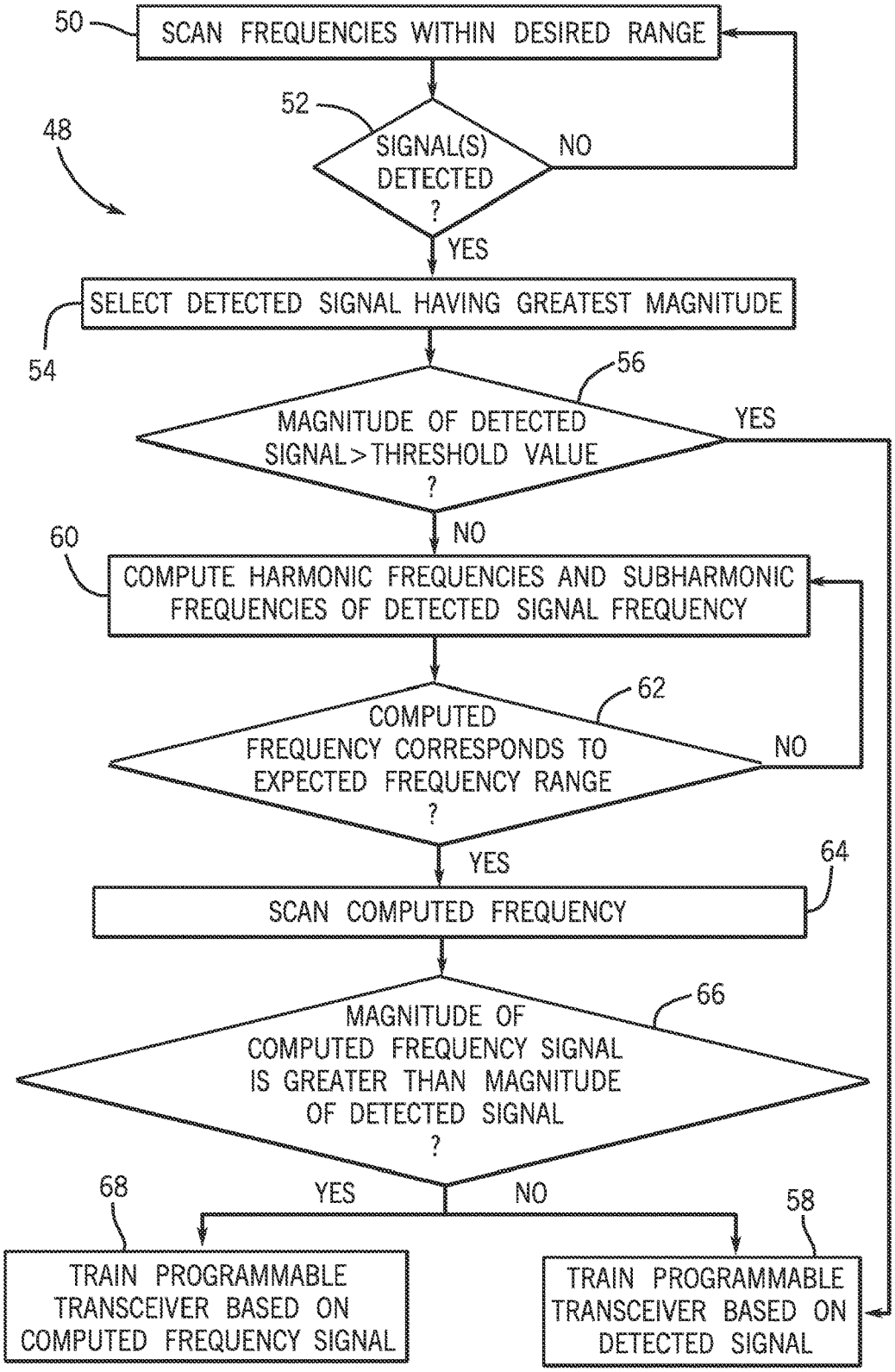
FIG. 4 is a flow diagram of an embodiment of a method for training a programmable transceiver.

FIG. 4 is a flow diagram of an embodiment of a method 48 for training a programmable transceiver. First, as represented by block 50, frequencies are scanned within a desired range. In certain embodiments, the desired range may be about 285 MHz to about 440 MHz. Alternatively, the desired range may include frequencies from about 867 MHz to about 869 MHz, and frequencies from about 900 MHz to about 930 MHz. However, it should be appreciated that other frequency ranges may be scanned in alternative embodiments. In certain embodiments, the process of scanning frequencies includes scanning upwardly through the desired range by a fixed frequency increment, and scanning downwardly through the desired range by the fixed frequency increment. For example, the fixed frequency increment may be about 100 kHz to about 1 MHz, about 125 kHz to about 800 kHz, about 150 kHz to about 500 kHz, or about 200 kHz. By way of further example, the fixed frequency increment may be about 200 kHz, about 300 kHz, about 400 kHz, about 500 kHz, or more. Once a signal is detected, a fine scan may be performed to precisely identify the frequency of the signal (e.g., via progressively decreasing the scanning frequency increment until the signal frequency is determined with a desired degree of precision). The process of performing a fine scan after the coarse scan may enhance the efficiency of the signal detection process.

The process of scanning frequencies within the desired range continues until one or more signals are detected, as represented by block 52. If multiple signals are detected within the desired range, the signal having the greatest magnitude is selected as the detected signal, as represented by block 54. For example, the programmable transceiver may receive multiple signals from various transmitters operating within a detectable range of the transceiver. However, because the training transmitter is positioned proximate to the programmable transceiver, the magnitude of the training transmitter signal may be higher than the magnitude of signals from more remote transmitters. Accordingly, selecting the signal having the greatest magnitude substantially reduces or eliminates the possibility of training the programmable transceiver based on a detected ambient signal.

Next, as represented by block 56, a magnitude of the detected signal is compared to a threshold value. As will be appreciated, the magnitude of harmonic frequencies and subharmonic frequencies is less than the magnitude of the corresponding fundamental frequency. Accordingly, if the detected signal has a magnitude that approaches the maximum output power of the training transmitter, the frequency of the detected signal corresponds to the fundamental broadcast frequency of the training transmitter. In the illustrated embodiment, the threshold value is selected based on the expected maximum output power to the training transmitter. Therefore, if the magnitude of the detected signal is greater than the threshold value, the programmable transceiver is trained based on the detected signal, as represented by block 58. In certain embodiments, the threshold value may be greater than 50 dB, 70 dB, 90 dB, or 100 dB, for example.

If the magnitude of the detected signal is less than or equal to the threshold value, harmonic frequencies and subharmonic frequencies of the detected signal frequency are computed, as represented by block 60. As will be appreciated, harmonic frequencies are frequencies that correspond to a multiple of the detected frequency, and subharmonic frequencies are frequencies that correspond to an inverse multiple (e.g., 1/n, 2/n, etc.) of the detected frequency. For example, harmonic frequencies may be 3/2, 2, or 3 times the fundamental frequency, and subharmonic frequencies may be ⅓, ½, or ⅔ of the fundamental frequency. By way of example, a signal having a 300 MHz fundamental frequency may include harmonic frequencies of 600 MHz, 900 MHz, and 1200 MHz, and subharmonic frequencies of 150 MHz, 100 MHz, and 75 MHz. To limit the number of scanned harmonic frequencies and subharmonic frequencies, the computed frequencies are compared to an expected frequency range, as represented by block 62, and only frequencies corresponding to the expected range are scanned, as represented by block 64.

For example, in certain embodiments, the desired frequency range includes frequencies from about 285 MHz to about 440 MHz, and the expected range includes frequencies within the desired frequency range, and frequencies from about 867 MHz to about 869 MHz, and from about 900 MHz to about 930 MHz. By way of example, if a frequency of about 434 MHz is detected, only one harmonic frequency, 868 MHz, is scanned because 868 MHz is the only harmonic frequency within the expected range. In addition, only one subharmonic frequency, 289.333 MHz, is scanned because 289.333 MHz is the only subharmonic frequency within the expected range. In further embodiments, the desired frequency range is about 867 MHz to about 869 MHz, and about 900 MHz to about 930 MHz, and the expected range includes frequencies within the desired frequency range, and frequencies from about 285 MHz to about 440 MHz. By way of example, if a frequency of about 900 MHz is detected, only one subharmonic frequency, 300 MHz, is scanned because 300 MHz is the only subharmonic frequency within the expected range. In addition, no harmonic frequencies are scanned because no harmonic frequency is within the expected range. While two desired frequency ranges and two expected frequency ranges are described above, it should be appreciated that other desired and expected ranges may be scanned in alternative embodiments.

Next, as represented by block 66, the magnitude of the signal at the computed frequency is compared to the magnitude of the detected signal. If the magnitude of the signal at the computed frequency is less than the magnitude of the detected signal, the programmable transceiver is trained based on the detected signal, as represented by block 58. Conversely, if the magnitude of the signal at the computed frequency is greater than the magnitude of the detected signal, the programmable transceiver is trained based on the signal at the computed frequency, as represented by block 68. In this manner, the possibility of training the programmable transceiver based on a signal at an incorrect frequency is substantially reduced or eliminated, thereby enabling the programmable transceiver to accommodate a wide variety of frequency ranges.

In certain embodiments, the sensitivity of the programmable transceiver may vary as a function of frequency. For example, the programmable transceiver may be more sensitive to frequencies within a range of about 867 MHz to about 869 MHz, and about 900 MHz to about 930 MHz, than to frequencies within a range of about 285 MHz to about 440 MHz. Consequently, a correction factor may be applied to the magnitude of a detected signal to compensate for the frequency dependent sensitivity variations. By way of example, if the programmable transceiver detects a signal at 434 MHz, the programmable transceiver may scan 868 MHz to determine if the detected signal (at 434 MHz) is the fundamental broadcast frequency of the training transmitter or a subharmonic frequency. However, if the programmable transceiver is more sensitive to 868 MHz than to 434 MHz, a correction factor may be applied to the magnitude of the higher frequency signal and/or to the magnitude of the lower frequency signal to facilitate an accurate comparison of the signal magnitudes. In this manner, the broadcast magnitudes, as compared to the detected magnitudes, may be compared to determine the stronger signal, thereby enhancing the probability that the programmable transceiver is trained based on the fundamental frequency of the training transmitter. By way of example, a correction factor of about +18 dB may be applied to signals having a frequency around 300 MHz, a correction factor of about +9 dB may be applied to signals having a frequency around 360 MHz or around 430 MHz, and a correction factor of about 0 dB may be applied to signals having a frequency around 868 MHz.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A method for training a programmable transceiver, comprising:

scanning frequencies, within a desired range for training the programmable transceiver, for a first signal broadcast by a transmitter;

detecting the first signal at a first frequency;

computing harmonic frequencies and subharmonic frequencies of the first frequency;

scanning the computed harmonic frequencies and the subharmonic frequencies of the first frequency for a second signal broadcast by the transmitter at a second frequency;

comparing a first magnitude of the first signal to a second magnitude of the second signal at one of the harmonic frequencies and the subharmonic frequencies of the first frequency;

selecting, as a training signal for training the programmable transceiver, one of the first signal at the first frequency if the first magnitude is greater than the second magnitude or the second signal at the second frequency if the second magnitude is greater than the first magnitude; and training the programmable transceiver based on the training signal selected from one of the first signal or the second signal.

2. The method of claim 1, wherein scanning the harmonic frequencies comprises scanning only the harmonic frequencies within a first expected range, and scanning the subharmonic frequencies comprises scanning only the subharmonic frequencies within a second expected range.

3. The method of claim 1, wherein the desired range comprises about 285 MHz to about 440 MHz.

4. The method of claim 1, wherein the desired range comprises about 867 MHz to about 869 MHz, and about 900 MHz to about 930 MHz.

5. The method of claim 2, wherein the desired range comprises about 285 MHz to about 440 MHz, and the first expected range comprises about 867 MHz to about 869 MHz, and about 900 MHz to about 930 MHz.

6. The method of claim 2, wherein the desired range comprises about 867 MHz to about 869 MHz, and about 900 MHz to about 930 MHz, and the second expected range comprises about 285 MHz to about 440 MHz.

7. The method of claim 1, wherein training the programmable transceiver comprises applying a correction factor to the first magnitude, the second magnitude, or a combination thereof, to compensate for frequency dependent variations in sensitivity of the programmable transceiver.

8. The method of claim 1, wherein detecting the first signal at the first frequency comprises detecting a plurality of candidate signals, and selecting the candidate signal having a greatest magnitude as the first signal.

9. The method of claim 1, comprising:

comparing the first magnitude of the first signal to a threshold value; and training the programmable transceiver based on the first signal if the first magnitude is greater than the threshold value.

10. The method of claim 1, wherein scanning frequencies within the desired range is initiated by depressing an unassigned button of the programmable transceiver.

11. A programmable transceiver, comprising:

a controller configured to:

scan frequencies, within a desired range for training the programmable receiver, for a first signal broadcast by a transmitter, detect the first signal at a first frequency, compute harmonic frequencies and subharmonic frequencies of the first frequency, scan the computed harmonic frequencies and the subharmonic frequencies of the first frequency for a second signal broadcast by the transmitter at a second frequency, compare a first magnitude of the first signal to a second magnitude of the second signal at one of the harmonic frequencies and the subharmonic frequencies of the first frequency, select, as a training signal for training the programmable transceiver, one of the first signal at the first frequency when the first magnitude is greater than the second magnitude or the second signal at the second frequency when the second magnitude is greater than the first magnitude; and train the programmable transceiver based on the training signal selected from one of the first signal or the second signal.

12. The programmable transceiver of claim 11, wherein the controller is configured to scan only the harmonic frequencies within a first expected range, and to scan only the subharmonic frequencies within a second expected range.

13. The programmable transceiver of claim 12, wherein the desired range comprises about 285 MHz to about 440 MHz, and the first expected range comprises about 867 MHz to about 869 MHz, and about 900 MHz to about 930 MHz.

14. The programmable transceiver of claim 12, wherein the desired range comprises about 867 MHz to about 869 MHz, and about 900 MHz to about 930 MHz, and the second expected range comprises about 285 MHz to about 440 MHz.

15. The programmable transceiver of claim 11, comprising a plurality of buttons, wherein depressing an unassigned button instructs the controller to scan frequencies within the desired range.

16. A programmable transceiver, comprising:

a transceiver configured to receive a training signal from a training transmitter;

a memory configured to store information associated with the training signal; and a controller configured to:

instruct the transceiver to scan frequencies, within a desired range for training the programmable transceiver, for a first signal broadcast by a transmitter, to detect the first signal at a first frequency, compute harmonic frequencies and subharmonic frequencies of the first frequency, instruct the transceiver to scan the harmonic frequencies and the subharmonic frequencies of the first frequency for a second signal broadcast by the transmitter at a second frequency, compare a first magnitude of the first signal to a second magnitude of the second signal at one of the harmonic frequencies and the subharmonic frequencies of the first frequency, establish the training signal for training the programmable transceiver based on the second signal if the second magnitude is greater than the first magnitude, and to otherwise establish the training signal based on the first signal, and store the information associated with the training signal established based on one of the first signal or the second signal in the memory.

17. The programmable transceiver of claim 16, wherein the controller is configured to instruct the transceiver to scan only the harmonic frequencies within a first expected range, and to scan only the subharmonic frequencies within a second expected range.

18. The programmable transceiver of claim 16, comprising a plurality of buttons, wherein depressing an unassigned button instructs the controller to initiate the frequency scan.

19. The programmable transceiver of claim 18, wherein the controller is configured to assign the information associated with the training signal to the unassigned button.

20. The programmable transceiver of claim 19, wherein depressing an assigned button instructs the transceiver to transmit the information associated with the training signal.

* * * * *